US006380841B2

(12) United States Patent
Masuda et al.

(10) Patent No.: US 6,380,841 B2
(45) Date of Patent: Apr. 30, 2002

(54) VARIABLE RESISTOR

(75) Inventors: Fumitoshi Masuda, Fukui-ken; Shigeki Takahashi, Omihachiman; Toru Ogata, Sabae; Tomohisa Ogawa, Sabae; Minoru Yamaguchi, Sabae; Yutaka Kitamura, Kaga, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/754,427

(22) Filed: Jan. 4, 2001

(30) Foreign Application Priority Data

Jan. 4, 2000 (JP) ..... 2000-000020

(51) Int. Cl.[7] ..... H01C 10/32

(52) U.S. Cl. ..... 338/163; 338/164; 338/166; 338/167; 338/184

(58) Field of Search ..... 338/118, 162, 338/163, 164, 166, 167, 184

(56) References Cited

U.S. PATENT DOCUMENTS 3,537,056 A * 10/1970 Van Benthoysen ..... 338/164
3,601,743 A * 8/1971 Mathison et al. ..... 338/164
3,631,371 A * 12/1971 Maurice ..... 338/164
4,482,883 A * 11/1984 Heredero ..... 338/163
4,521,761 A * 6/1985 Welch ..... 338/174
4,712,084 A * 12/1987 Okazaki et al. ..... 338/184
4,998,088 A * 3/1991 Masuda ..... 338/162
5,043,695 A * 8/1991 Simon et al. ..... 338/199

FOREIGN PATENT DOCUMENTS

JP 5-59561 * 9/1986
JP 5-0031-8 * 11/1991

* cited by examiner

*Primary Examiner*—Karl D. Easthom
(74) *Attorney, Agent, or Firm*—Keating & Bennett, LLP

(57) ABSTRACT

A variable resistor is constructed to reliably seal the space between a rotor and a substrate without insert-molding the substrate into a case, and to be produced at a very low cost. This variable resistor includes a hollow square-prism shaped case which is open at the top and the bottom, a substrate which is fitted into the lower opening of the case, and on the top surface of which a collector electrode and an arcuate resistor are provided, a rotor rotatably fitted into the upper opening of the case, a slider mounted on the bottom surface of the rotor and making sliding contact with the collector electrode and the resistor, an annular packing member disposed between the rotor and the substrate for sealing the space therebetween, terminals mounted on the substrate and electrically connected to the resistor and the collector electrode, and a metallic cover.

19 Claims, 6 Drawing Sheets

VARIABLE RESISTOR

BACKGROUND OF THE INVENTION

1. Field of the Invention

The present invention relates to a variable resistor used in commercial equipment such as hearing aids, measuring instruments, communication devices, and sensors, and more particularly, to a small variable resistor.

2. Description of the Related Art

As a known example of such a variable resistor, Japanese Examined Patent Application Publication No. 5-59561 discloses a variable resistor wherein a resistor substrate on which terminals are mounted is insert-molded into a resin case, a rotor on which a slider is installed and an O-ring are accommodated in the case, the rotor is prevented from rising by placing a metallic cover on the case, and the cover is prevented from slipping off by engaging protrusions provided on the sides of the case with holes in leg portions provided on the cover.

As another known example of such a variable resistor, Japanese Unexamined Patent Application Publication No. 5-3108 discloses a variable resistor wherein a metallic cover is placed on a case from the upper portion thereof, and leg portions protruding from the cover are folded inwardly along the bottom surface of the case.

In each of these variable resistors, the resistor substrate is insert-molded into the case to provide heat resistance and superior sealing characteristics when the variable resistor is soldered to a printed circuit board. Hence, the resistor substrate (particularly, in the case of a ceramic substrate) is prone to cracking during molding, or molding resin may flow onto the surface of the substrate on which the resistor is provided, resulting in the formation of an insulating film thereon. Furthermore, in these variable resistors, it is necessary to take special steps to prevent the resin from intruding into the inside of the substrate, in order to prevent any insulating film from being located on the surface of the substrate. These problems result in reduced productivity and increased cost.

SUMMARY OF THE INVENTION

To overcome the above-described problems, preferred embodiments of the present invention provide a variable resistor which reliably seals the space between a rotor and a substrate without insert-molding the substrate into a case, and which resistor is produced at a greatly reduced cost.

Preferred embodiments of the present invention provide a variable resistor including a case which is open at the top and the bottom, a substrate which is fitted into the lower opening of the case, the substrate including a collector electrode on the top surface thereof and an arcuate resistor provided around said collector electrode, a rotor rotatably fitted into the upper opening of the case, a slider mounted on the bottom surface of the rotor and making sliding contact with the collector electrode and the resistor, an annular packing member disposed between the rotor and the substrate for sealing the space therebetween, and a metallic cover having a top plate portion for supporting the top surface of the rotor, a hole provided at the top plate portion such that a portion of the rotor is exposed, and a pair of leg portions extending downward along the sides of the case. The metallic cover supports the bottom surface of the substrate such that the metallic cover is disposed on the case from the upper portion of the case and the leg portions thereof are folded inwardly along the bottom surface of the case.

When assembling this variable resistor, first, the substrate is fitted into the lower opening of the case, and then the rotor is fitted into the upper opening of the case. It is preferable that the annular packing member be disposed on the top surface of the substrate and the slider be mounted on the bottom surface of the rotor in advance. Next, when putting the metallic cover on the case from the upper portion of the case, the pair of leg portions extend downwardly along the sides of the case. In this situation, a portion of the rotor is exposed from the window hole. The leg portions are folded inwardly along the bottom surface of the case and support the bottom surface of the substrate by the tip portions thereof. Thereby, the rotor is prevented from rising, the substrate is prevented from slipping off from the case, and the packing member and the slider are sandwiched between the rotor and the substrate. That is, a closed space is provided between the rotor and the substrate. By disposing the slider, the resistor, and the collector electrode, within this space, the intrusion of moisture and solder flux from the outside is prevented, which produces a variable resistor that achieves very stable performance.

Preferably, a spacer portion to maintain a desired spacing between the rotor and the substrate is provided on the inner surface of the case. Thereby, variations in assembly are avoided, and the compression allowance between the slider and the packing in the assembling process is uniform, and hence the electrical characteristics and the sealing characteristics of this variable resistor are very stable and uniform.

Furthermore, it is preferable that the packing member be directly applied on the top surface of the substrate, and on the outer peripheral side of the resistor. The packing member may instead be provided separately from the substrate and the rotor, and the packing may be disposed therebetween. However, in this case the packing member is prone to cause positional deviations, and it is difficult to maintain stable sealing characteristics. In contrast, the direct application of the packing onto the top surface of the substrate reliably prevents positional deviations thereof.

Moreover, guide grooves for guiding the leg portions of the metallic cover are preferably provided on the outer side-surfaces of the case. This stabilizes the positioning of the cover on the case, and facilitates the assembly thereof.

The features, characteristics, elements and advantages of the present invention will be clear from the following detailed description of preferred embodiments of the invention in conjunction with the accompanying drawings.

BRIEF DESCRIPTION OF THE DRAWINGS

FIGS. 2A through 2C are diagrams illustrating the variable resistor shown in FIG. 1, wherein FIG. 2A is a plan view thereof, FIG. 2B is a front view thereof, and FIG. 2C is a bottom view thereof;

FIGS. 6A through 6C are diagrams illustrating a rotor in accordance with preferred embodiments of the present invention, wherein FIG. 6A is a plan view thereof, FIG. 2B is a sectional view taken along a line Z—Z in FIG. 6A, and FIG. 6C is a bottom view of the rotor;

DETAILED DESCRIPTION OF PREFERRED EMBODIMENTS

Figure 1:
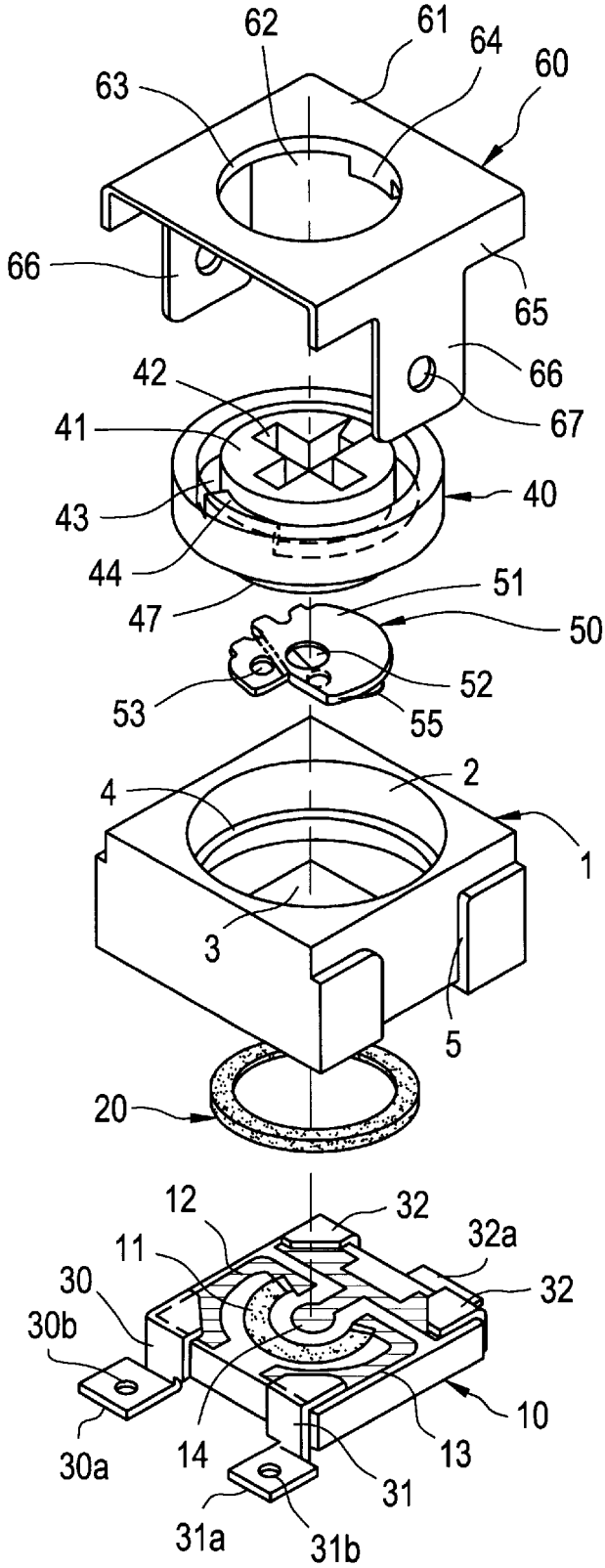
FIG. 1 is an exploded perspective view showing a preferred embodiment of a variable resistor in accordance with the present invention.
Figure 2A:
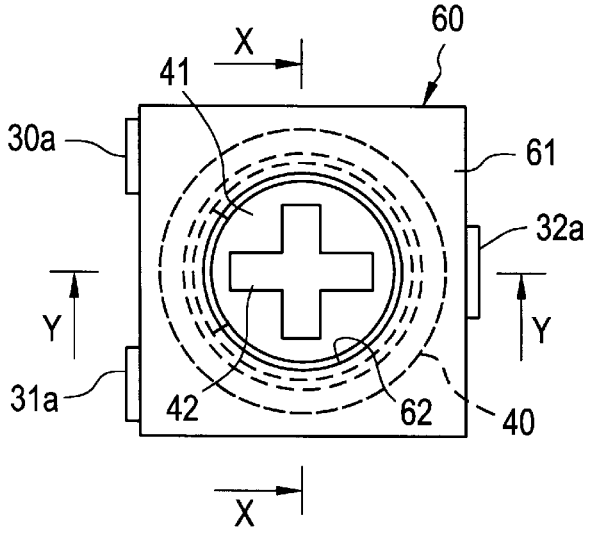
Figure 2B:
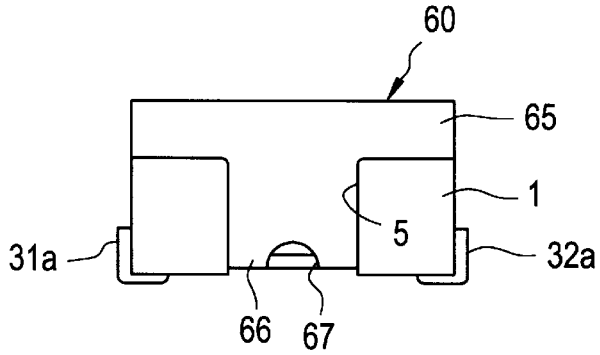
Figure 2C:
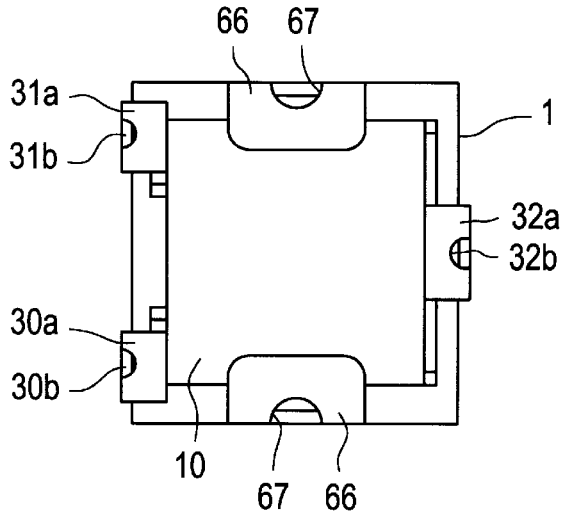
Figure 3:
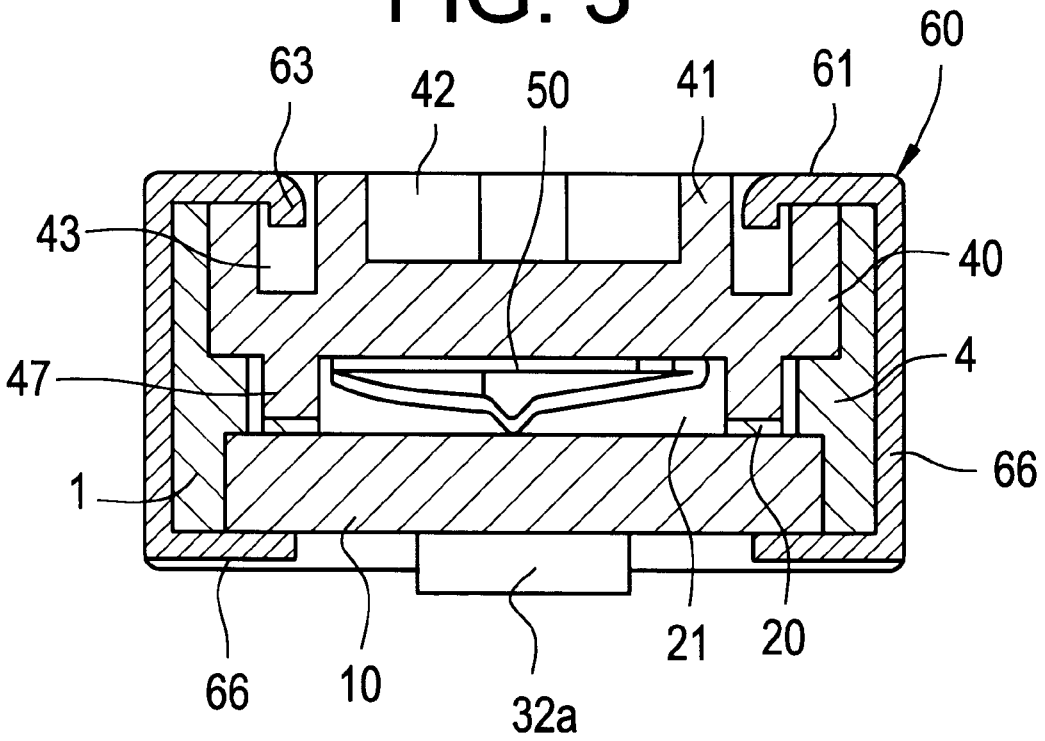
FIG. 3 is a sectional view taken along a line X—X in FIG. 2A.
Figure 4:
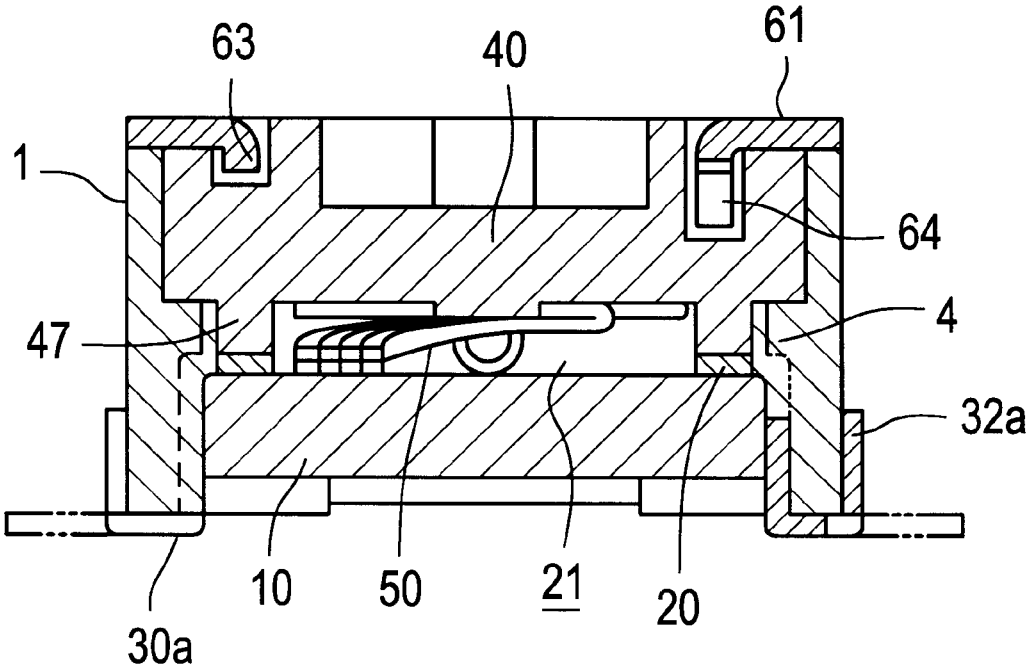
FIG. 4 is a sectional view taken along a line Y—Y in FIG. 2A.

FIGS. 1 through 8D shows a preferred embodiment of a variable resistor in accordance with the present invention.

This variable resistor includes a case 1, a resistor substrate 10, a packing 20, lead terminals 30 through 32, a rotor 40, a slider 50, a metallic cover 60 or the like.

The case 1 is made of a thermoplastic resin such as a heat-resistant polyamide, e.g., 46 nylon, polyphenylene sulfide, polybutylene terephthalate, or a liquid-crystal polymer, or a thermosetting resin such as an epoxy resin, diarylphthalate, or an unsaturated polyester, to withstand the soldering heat, and to allow a stable operation under high-temperature conditions. The case 1 preferably has a substantially cylindrical shape which is open at the top and the bottom, and has a substantially circular upper opening 2 provided at the upper portion thereof and a substantially rectangular lower opening 3 provided at the lower portion thereof. An annular spacer portion 4 for securing a desired spacing for disposing the packing 20 between the rotor 40 and the resistor substrate 10 protrudes from the inner surface at the intermediate portion in the vertical direction. Guide grooves 5 are provided on two opposing outer side-surfaces of the case 1.

Figure 5:
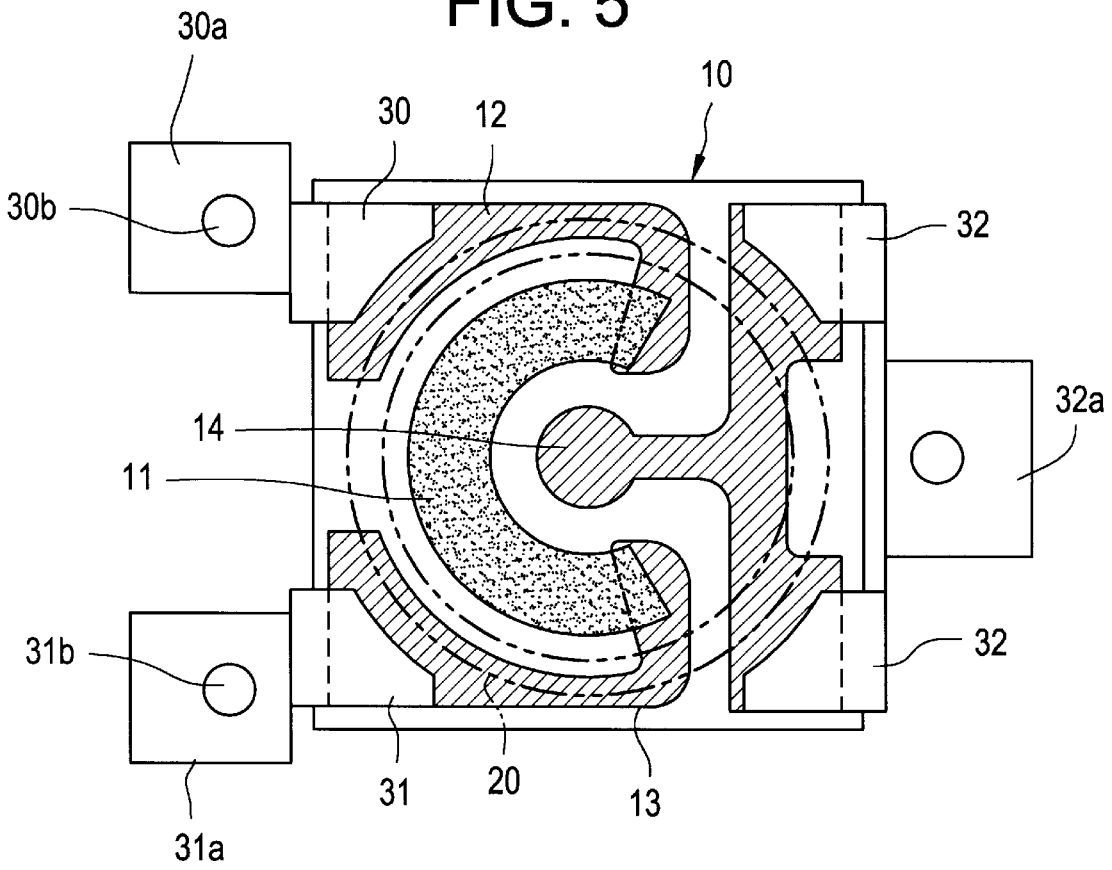
FIG. 5 is a plan view showing a resistor substrate in accordance with a preferred embodiment of the present invention.
Figure 6A:
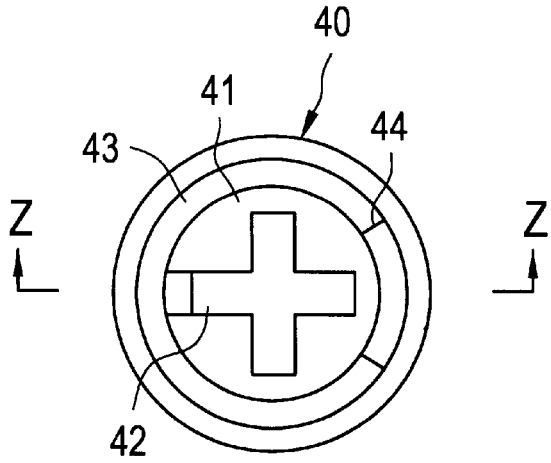
Figure 6B:
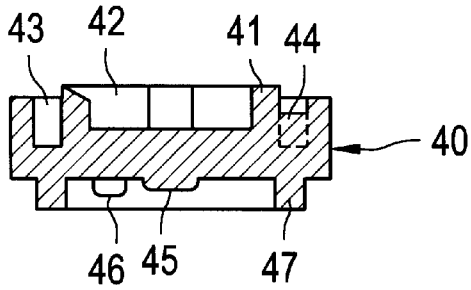
Figure 6C:
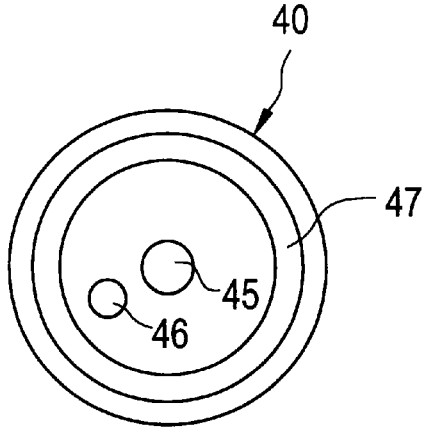
Figure 7:
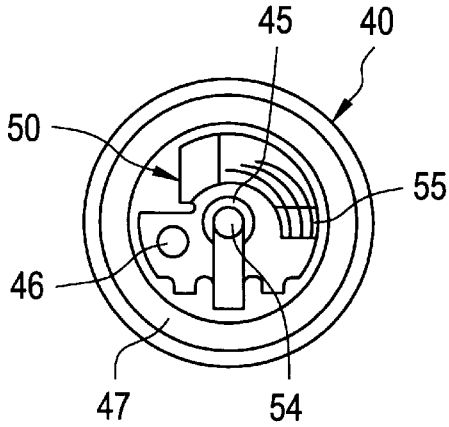
FIG. 7 is a bottom view illustrating the rotor shown in FIGS. 6A through 6C on which a slider in accordance with preferred embodiments of the present invention has been mounted.
Figure 8A:
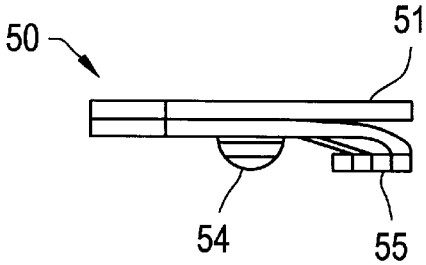
FIGS. 8A through 8D illustrate a plan view, a front view, a left-side view, and right-side view of the slider shown in FIG. 7.
Figure 8C:
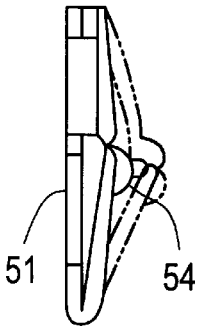
Figure 8B:
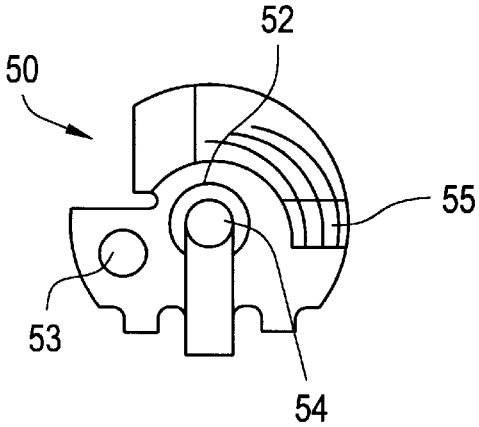
Figure 8D:
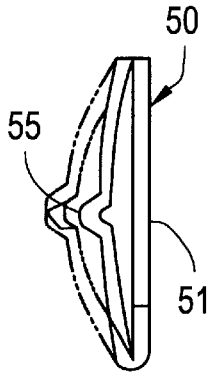

The resistor substrate 10 is fitted in the lower opening 3 of the case 1. The resistor substrate 10 is defined by a substantially rectangular plate using a ceramic material such as alumina, or a heat-resistant resin such as polyphenylene sulfide or a liquid-crystal polymer. As shown in FIG. 5, a substantially C-shaped resistor 11, made of, for example, a cermet resistor or a carbon resistor, is provided on the top surface of the resistor substrate 10 by a method such as screen printing or transfer. Both ends of the resistor 11 are extended out to one side-edge of the substrate 10 via electrodes 12 and 13 provided on the substrate 10. Also, a collector electrode 14 positioned at the approximate center of the resistor 11 is provided on the top surface of the substrate 10, and is led out to the other side-edge of the substrate 10. The depth in which the resistor substrate 10 is fitted into the case 1 is determined to abut the top surface of the resistor substrate 10 against the bottom surface of the spacer portion 4 provided on the inner surface of the case 1 (see FIGS. 3 and 4).

On the top surface of the substrate 10, the packing member 20 is formed as an annulus which exerts a stable packing effect while being subjected to the soldering heat or variations in the operating temperature and which has superior electrical insulating characteristics. Specifically, silicone rubber, fluorine rubber, or fluorosilicone rubber is directly applied and cured on the top surface of the resistor substrate 10 to surround the resistor 11.

To both side-edges of the resistor substrate 10 where the electrodes 12 and 13 and the collector electrode 14 are led out, three lead terminals 30, 31, and 32 are affixed via welding, thermal pressure-contact by a heater chip, or soldering, and are electrically connected to the electrodes 12, 13, and 14, respectively. Particularly, the lead terminals 32 together define a fork shape, and are connected to the lead-out portions of the collector electrode 14 at two points. External connecting portions 30*a* through 32*a* of the lead terminals 30 through 32 are led out from surfaces other than the sides on which the guide grooves 5 of the case 1 are provided, and are folded upward along the outer side-surfaces of the case 1. To facilitate folding the external connecting portions 30*a* through 32*a*, holes 30*b* through 32*b* are provided in the external connecting portions 30*a* through 32*a*. Alternatively, the external connecting portions 30*a* through 32*a* may be led out in the horizontal direction without being folded.

The rotor 40 is made of a heat-resistant resin, such as polyphenylene sulfide or a liquid-crystal polymer, into a substantially columnar shape, and is rotatably fitted into the upper opening 2 of the case 1. A columnar boss portion 41 protrudes at the approximate central portion of the top surface of the rotor 40. On the top surface of this boss portion 41, a cross-shaped tool-engaging groove 42 with which a tool such as a driver is engaged is provided. An annular groove 43 is provided on the outer periphery of the boss portion 41, and a stopper 44 is provided at a desired position of the annular groove 43. A protrusion 45 for positioning is provided at the approximate central portion of the bottom surface of the rotor 40, and a detent protrusion 46 (see FIGS. 6B and 6C) is provided at an eccentric position of the bottom surface. An annular wall 47 protrudes to surround the above-mentioned protrusions 45 and 46. The annular wall 47 contacts the packing 20 provided on the resistor substrate 10, and defines a closed space 21 (see FIGS. 3 and 4) between the rotor 40 and the resistor substrate 10. It is to be noted that, when the rotor 40 is fitted into the upper opening 2 of the case 1, the spacing between the rotor 40 and the resistor substrate 10 is uniform due to the abutting of the bottom surface of the rotor 40 against the top surface of the spacer portion 4, resulting in a uniform compression allowance (described below) between the slider 50 and the packing 20.

The slider 50 is preferably made of a material having superior spring characteristics and electrical conductivity, such as copper alloy, stainless steel, or noble-metal-based alloy, and has a substantially disk-shaped base portion 51 provided on the top side thereof. As shown in FIGS. 8A through 8D, holes 52 and 53 to fit into the protrusions 45 and 46 of the rotor 40 are provided in the base portion 51. The slider 50 is affixed to the rotor 40 and prevented from rotating with respect to the rotor 40. Here, the slider 50 is fixed via thermal-caulking the protrusions 45 and 46 after fitting the holes 52 and 53 of the slider 50 to the protrusions 45 and 46. On the outer peripheral portion of the base 51, an arm-shaped central contact-point portion 54 and a comb shaped sliding contact-point portion 55 are continuously provided, and these contact-point portions 54 and 55 are folded back below the base portion 51. Meanwhile, in FIG. 8, the two-dot chain lines indicate free positions of the central contact-point portion 54 and the sliding contact-point portion 55. The central contact-point portion 54 elastically presses against the collector electrode 14, and the sliding contact-point portion 55 elastically presses against the resistor 11.

The metallic cover 60 is preferably made of stainless steel or a copper alloy such as nickel silver, which are both rust-proof and have non-solder wettable characteristics. The cover 60 includes a top plate 61 disposed on the top surface of the case 1 to prevent the rotor 40 from rising. At the approximate center of the cover 60, a substantially circular window hole 62 is provided from which the columnar boss portion 41 of the rotor 40 is exposed. The inner edge portion 63 of the window hole 62 is folded downward, and is inserted into the annular groove 43 of the rotor 40. A stopper member 64 which protrudes downward is provided at one portion of the inner edge portion 63. The rotational angle of the rotor 40 is limited by the stopper member 64 abutting against the stopper portion 44 of the annular groove 43. Skirt portions 65 are provided, each having the same width and extending along two sides of the top plate 61, and tongue-shaped leg portions 66 are provided, each protruding downward from the lower edges of these skirt portions 65. When the cover 60 is placed on the case 1, the leg portions 66 are engaged with the guide grooves 5 of the case 1 and protrude below the bottom surface of the case 1. Then, by folding the tip of each of the leg portions 66 inward along the bottom surface of the case 1, the cover 60 is affixed to the case 1. In this preferred embodiment, to facilitate folding the leg portions 66 inward, the leg portions 66 are provided with holes 67.

Next, the method for assembling the variable resistor in accordance with the above-described preferred embodiment will be described.

First, the resistor substrate 10 is fitted into the lower opening 3 of the case 1. The lead terminals 30 through 32 are fixed on the resistor substrate 10 and the packing member 20 is applied beforehand. Then, the rotor 40 is fitted into the upper opening 2 of the case 1. At this time, since the slider 50 has been mounted on the bottom surface of the rotor 40, the rotor 40 is lifted off from the case 1.

Next, the metallic cover 60 is placed on the case 1, and the leg portions 66 of the cover 60 are each inserted into the guide grooves 5 on the side surfaces of the case 1. Then, by folding inward the legs 66 protruding downward from the lower end surface of the case 1, the led portions 66 are engaged with the bottom surface of the case 1. Thereby, the top plate portion 61 of the cover 60 presses down the top surface of the rotor 40, and causes the bottom surface of the rotor 40 to abut, or substantially abut, against the top surface of the spacer portion 4. Simultaneously, the leg portions 66 support the bottom surface of the resistor substrate 10, and press the top surface of the resistor substrate 10 on the bottom surface of the spacer portion 4. As a result, all components including the rotor 40 and the resistor substrate 10 are integrally assembled in the case 1, the spacing between the rotor 40 and the resistor substrate 10 is maintained substantially uniform, and the compression allowances between the slider 50 and the packing 20 is uniform. In other words, the sealing pressure of the packing 20 is uniform. Thus, variations in sealing characteristics are eliminated, and also the spring pressure of the slider 50 is uniform, which results in very stable electrical characteristics.

In the variable resistor thus assembled, by rotating the rotor 40 with the tip of a driver engaged with the tool-engaging groove 42, the sliding contact-point portion 55 slides on the resistor 11 while the approximately central contact-point portion 54 is kept in contact with the collector electrode 14. This allows the resistance between the terminal 30 and the terminal 32, and that between the terminal 31 and the terminal 32 to be adjusted. When the rotor is stopped at a desired position, the rotation of the rotor 40 is limited by the frictional force of the packing 20, and hence deviation of the contact position between the resistor 11 and the sliding contact-point portion 55 is greatly suppressed, whereby the resistance value is stabilized.

The variable resistor in accordance with the present invention is not limited to the above-described preferred embodiments, but may be modified within the spirit of the invention.

In the above-described preferred embodiments, although the example wherein the packing member 20 is affixed on the resistor substrate 10 is described, the present invention is not restricted to this configuration. For example, the sealing between the rotor 40 and the resistor substrate 10 may be performed by fitting an O-ring to the lower end of the rotor 40, and by pressing this O-ring against the resistor substrate 10.

Also, in the above-described preferred embodiments, the lead terminals 30 through 32 are fixed to the resistor substrate 10, and thereby a surface-mount type variable resistor is produced. However, a variable resistor with lead terminals may be formed by configuring the lead terminals to protrude downward. Alternatively, the lead terminals may be omitted by leading out the electrodes 12 through 14 to the bottom surface side of the substrate 10.

As is evident from the above-described description, in accordance with various preferred embodiments of the present invention, all components including the rotor and the resistor substrate are integrally assembled in the case by providing the pair of leg portions for the metallic cover placed on the case from the upper portion of the case, and by folding these legs inward along the bottom surface of the case. Therefore, unlike conventional examples, it is essential only that the substrate be fitted into the lower opening of the case without insert-molding the substrate into the case. This leads to a significant reduction in the production cost.

Furthermore, since the rotor and the substrate press against each other with the packing interposed therebetween by folding the leg portions of the metallic cover, a closed space in which the slider is disposed is provided therebetween. This prevents the intrusion of moisture and solder flux from the outside, and thereby allows a stable electrical performance of this variable resistor to be maintained.

While the present invention has been described with reference to the preferred embodiments, it is to be understood that various changes and modifications may be made thereto without departing from the invention in its broader aspects and therefore, it is intended that the appended claims cover all such changes and modifications as fall within the scope of the invention.

What is claimed is:

1. A variable resistor comprising:

a case which is open at a top surface and a bottom surface thereof;

a substrate fitted into the lower opening of the case, the substrate including a collector electrode on the top surface thereof and an arcuate resistor disposed around said collector electrode;

a rotor rotatably fitted into the top opening of the case;

a slider mounted on the bottom surface of the rotor, the slider arranged to make sliding contact with said collector electrode and said arcuate resistor;

an annular packing member disposed between the rotor and the substrate, the annular packing member arranged to seal the space therebetween; and a metallic cover having a top plate portion supporting the top surface of the rotor, a hole provided at said top plate portion such that a portion of the rotor is exposed, and a pair of leg portions extending downward along two sides of the case, wherein the metallic cover directly contacts and supports the bottom surface of the case such that the metallic cover is placed on the case from the upper portion of the case and the leg portions thereof are folded inwardly along and in direct contact with the bottom surface of the case and the bottom surface of the substrate.

2. A variable resistor as claimed in claim 1, wherein a spacer potion is arranged to maintain a desired spacing between the rotor and the substrate and is provided on the inner surface of said case.

3. A variable resistor as claimed in claim 1, wherein said packing member is directly applied on the top surface of the substrate, and on the outer peripheral side of the resistor.

4. A variable resistor as claimed in claim 1, wherein a guide groove to guide each of the leg portions of the metallic cover is provided on the outer surface of said case.

5. A variable resistor as claimed in claim 1, wherein each of said leg portions includes a hole to accommodate the inward folding of said leg portions.

6. A variable resistor as claimed in claim 1, wherein said case is made of a thermoplastic resin.

7. A variable resistor as claimed in claim 1, wherein said case is made of a heat-resistant polyamide.

8. A variable resistor as claimed in claim 1, wherein said case has a substantially cylindrical shape.

9. A variable resistor as claimed in claim 1, wherein said substrate further includes at least two electrodes which extend out to side edges of said substrate.

10. A variable resistor comprising:

a case which is open at a top surface and a bottom surface thereof;

a resistor substrate fitted into the lower opening of the case;

a rotor rotatably fitted into the top opening of the case;

a slider mounted on the bottom surface of the rotor, the slider arranged to make sliding contact with said resistor substrate;

an annular packing member disposed between the rotor and the resistor substrate, the annular packing member being arranged to seal the space therebetween; and a metallic cover having a top plate portion for supporting the top surface of the rotor, a hole provided at said top plate portion such that a portion of the rotor is exposed, and a pair of leg portions extending downward along two sides of the case, wherein the metallic cover directly contacts and supports the bottom surface of the substrate and the bottom surface of the case such that the metallic cover is placed on the case from the upper portion of the case and the leg portions thereof are folded inwardly along and in direct contact with the bottom surface of the case and the bottom surface of the substrate.

11. A variable resistor as claimed in claim 10, wherein the resistor substrate includes a collector electrode on the top surface thereof and an arcuate resistor disposed around said collector electrode.

12. A variable resistor as claimed in claim 11, wherein said slider makes contact with said collector electrode and said arcuate resistor.

13. A variable resistor as claimed in claim 10, wherein a spacer potion is arranged to maintain a desired spacing between the rotor and the resistor substrate and is provided on the inner surface of said case.

14. A variable resistor as claimed in claim 10, wherein said packing member is directly applied on the top surface of the resistor substrate, and on the outer peripheral side of the arcuate resistor.

15. A variable resistor as claimed in claim 10, wherein a guide groove to guide each of the leg portions of the metallic cover is provided on the outer surface of said case.

16. A variable resistor as claimed in claim 10, wherein each of said leg portions includes a hole to facilitate the inward folding of said leg portions.

17. A variable resistor as claimed in claim 10, wherein said case is made of a thermoplastic resin.

18. A variable resistor as claimed in claim 10, wherein said case is made of a heat-resistant polyamide.

19. A variable resistor as claimed in claim 10, wherein said case has a substantially cylindrical shape.

* * * * *